US008166789B2

(12) United States Patent
Okui et al.

(10) Patent No.: US 8,166,789 B2
(45) Date of Patent: May 1, 2012

(54) PIPE OR TUBE REDUCING MILL AND ROLL FOR REDUCING MILL

(75) Inventors: Tatsuya Okui, Osaka (JP); Koichi Kuroda, Osaka (JP)

(73) Assignees: Sumitomo Metal Industries, Ltd., Osaka (JP); Sumitomo Pipe and Tube Co., Ltd., Ibaraki (JP)

( * ) Notice: Subject to any disclaimer, the term of this patent is extended or adjusted under 35 U.S.C. 154(b) by 1015 days.

(21) Appl. No.: 10/586,616

(22) PCT Filed: Jan. 20, 2005

(86) PCT No.: PCT/JP2005/000704

§ 371 (c)(1),
(2), (4) Date: Aug. 1, 2008

(87) PCT Pub. No.: WO2005/070574

PCT Pub. Date: Aug. 4, 2005

(65) Prior Publication Data

US 2008/0289391 A1 Nov. 27, 2008

(30) Foreign Application Priority Data

Jan. 21, 2004 (JP) ..... 2004-012838

(51) Int. Cl.
*B21B 13/08* (2006.01)

(52) U.S. Cl. ..... 72/234

(58) Field of Classification Search ..... 72/112, 72/199, 224, 252.5, 370.23, 370.25, 234, 72/235

See application file for complete search history.

(56) References Cited

U.S. PATENT DOCUMENTS

| | | | | |
|---|---|---|---|---|
| 3,842,635 | A * | 10/1974 | Bibighaus | 72/224 |
| 3,952,570 | A | 4/1976 | Demny et al. | |
| 4,311,033 | A | 1/1982 | Demny et al. | |
| 5,533,370 | A | 7/1996 | Kuroda et al. | |

FOREIGN PATENT DOCUMENTS

| | | |
|---|---|---|
| DE | 23 33 916 | 1/1975 |
| DE | 28 44 042 | 4/1980 |
| JP | 04-158907 | 6/1992 |
| JP | 06-210318 | 8/1994 |
| JP | 06-238308 | 8/1994 |
| JP | 2000-051904 | 2/2000 |
| JP | 2000-334504 | 12/2000 |

OTHER PUBLICATIONS

Karl E. Kummant, "Computerized management of stretch reducing mill rolls", Iron and Steel Engineer, No. 6, Jun. 1989, pp. 32-36.

* cited by examiner

*Primary Examiner* — Teresa Ekiert
(74) *Attorney, Agent, or Firm* — Clark & Brody

(57) ABSTRACT

A reducing mill includes a plurality of stands disposed along a rolling direction line. The stands each include n rolls (n≧3) disposed around the rolling direction line, the n rolls are shifted by 180°/n around the rolling direction line from n rolls included in a preceding stand. The n rolls included in each of the stands excluding the last stand each have a groove having an arch shape. The bottom of the groove has a circular arc shape around the rolling direction line having a first radius in cross section. The distance between the surface of a roll flange portion between the bottom and the edge of the groove and the rolling direction line is longer than the first radius. The distance between the edge of the groove and the rolling direction line is longer than the first radius in the groove of a roll included in the preceding stand.

7 Claims, 9 Drawing Sheets

PIPE OR TUBE REDUCING MILL AND ROLL FOR REDUCING MILL

TECHNICAL FIELD

The present invention relates to tube reducing mills, and more particularly, to a pipe or tube reducing mill (hereinafter as reducing mill) including a plurality of stands disposed along a rolling direction line through which pipes or tubes stream.

BACKGROUND ART

A reducing mill such as a sizer and a stretch reducer is used for rolling a tube so that the tube has a prescribed outer size. Known types of reducing mills include a two-roll reducing mill including a plurality of stands each having two rolls, a three-roll reducing mill, and a four-roll reducing mill.

Such a reducing mill typically includes a plurality of stands disposed along a rolling direction line. Each of the stands includes a plurality of rolls having grooves that define a pass shape. For example, in the three-roll reducing mill, three rolls are disposed at equal intervals around the rolling direction line and shifted by 60° around the rolling direction line from those included in the preceding stand. This is for the purpose of equalizing as much as possible the distribution of radial stress exerted on the outer circumference of a pipe or tube (hereinafter as tube) in the process of rolling.

Each of the stands in the four-roll reducing mill includes four rolls having grooves that define a pass shape. The four rolls are disposed at equal intervals around the rolling direction line and shifted by 45° around the rolling direction line from those in the preceding stand.

In general, the each grooved roll included in each of the stands in the reducing mill has an arch shape in cross section. As shown in FIG. 1, the grooved roll 200 in a three-roll reducing mill has an arc shape of the radius R1 in cross section, which has its center GC on an extension of a segment on the side of the rolling direction line RA that connects the groove bottom GB and the rolling direction line RA. The radius R1 is longer than the distance DB between the groove bottom GB and the rolling direction line RA, so that the distance between the rolling direction line RA and the inner surface of the groove is shortest at DB and longest at DE that connects the rolling direction line RA and the groove edge GE. In short, the groove of the roll 200 has an approximately elliptical arc shape whose minor semi-axis equals DB.

By using the rolls 200, the reduction per stand can be increased. Furthermore, a gap is formed between the outer surface of the tube in the process of rolling and the groove edge GE of the roll 200, and therefore overfilling at the roll gap can be prevented, which can prevent roll edge marks on the outer surface of the tube.

By using the rolls 200, however, large radial stress is exerted on the part of the tube that contacts the bottom of the rolls 200. The distribution of the radial stress during rolling is unequal at the outer circumference of the tube, and the amount of deformation in the radial direction is unequal. The unequal radial deformation results in so-called "polygon formation." More specifically, as shown in FIG. 2, the shape of the inner surface of the rolled tube is not circular but hexagonal in cross section.

In order to prevent the polygon formation, the distribution of the radial stress exerted on the tube in the process of rolling should be equal. In order to allow the radial stress to be distributed equally, the pass shape profile formed by three rolls should be approximated to a perfect circle. More specifically, the center GC of the arc of the grooved roll 200 should be closer to the rolling direction line RA.

However, when the center GC of the grooved roll 200 is positioned closer to the rolling direction line RA, the gap between the outer circumference of the tube in the process of rolling and the groove edge GE of the roll 200 is reduced. Therefore, overfilling is more easily generated. During rolling, the load exerted on the part of the tube that contacts with the part of the groove surface in the vicinity of the edge GE increases, which is more likely to cause roll edge marks at the part of the tube. More specifically, string-shaped flaws are generated in the longitudinal direction of the tube.

As described above, during rolling the tube, it was difficult to prevent both the polygon formation and the roll edge marks and improve the quality of the tube.

JP 6-238308 A and JP 6-210318 A disclose countermeasures to improve the quality of the tube by rolling with three or more rolls.

A method of rolling with rolls 300 shown in FIG. 3 is disclosed by JP 6-238308 A. The groove bottom 301 of the roll 300 in FIG. 3 has an arc shape in cross sectional whose radius is R1 and its center GC1 is positioned on an extension of a segment on the side of the rolling direction line RA that connects the bottom center GB and the rolling direction line RA. A roll flange portion 302 positioned between the bottom 301 and the groove edge GE is in an arc shape whose radius R2 is larger than the radius R1 and its center GC2 is positioned on an extension on the side of the center GC1 of a segment connecting the end 303 of the bottom 301 and the center GC1. The radius R2 is larger than the distance DB between the bottom center GB in the grooved roll 300 in the preceding stand and the rolling direction line RA. According to the disclosure, by using the rolls 300 for rolling, polygon formation and roll edge marks can be prevented.

However, the center GC1 of the arc of the groove bottom 301 of the roll 300 is positioned on an extension of a segment on the side of rolling direction line RA connecting the bottom center GB and the rolling direction line RA. In short, the grooved roll 300 has an approximately elliptical arc shape whose minor semi-axis equals the distance DB between the rolling direction line RA and the bottom center GB. Therefore, the distribution of radial stress exerted upon the outer circumference of the tube in the process of rolling is not equal and polygon formation could not sufficiently be suppressed.

Meanwhile, JP 6-210318 A discloses a method of rolling using a four-roll reducing mill. According to the disclosure, the radius of curvature of the part of the roll for use in the vicinity of the groove edge is larger than the radius of curvature of the groove bottom, and smaller than the radius of curvature of the groove bottom of the roll in the preceding stand, so that polygon formation can be prevented.

However, the use of such rolls can prevent the polygon formation while roll edge marks are more likely to be caused. Since the distance between the groove edge of the roll and the rolling direction line is shorter than the outer radius of the tube on the stand inlet side, so that overfilling is more likely to be caused, and the load exerted on the part of the tube in contact with the part of the groove surface in the vicinity of the groove edge is large.

DISCLOSURE OF THE INVENTION

It is an object of the invention to provide a pipe or tube reducing mill that allows both polygon formation and roll edge marks to be suppressed.

A reducing mill according to the invention includes a plurality of stands disposed along a rolling direction line, in which a pipe or tube is rolled through the plurality of stands along the rolling direction line. The stands each include n rolls (n≧3) disposed around the rolling direction line, and the n rolls are disposed shifted by 180°/n around the rolling direction line from n rolls included in a preceding stand. The n rolls included in each of the plurality of stands excluding the last stand each have a groove having an arch shape in cross section. The bottom of the groove has a circular arc shape around the rolling direction line having a first radius in cross section, and the distance between the surface of a roll flange portion positioned between the bottom and the edge of the groove and the rolling direction line is longer than the first radius, and the distance between the edge of the groove and the rolling direction line is longer than the first radius in the groove of a roll included in the preceding stand.

In the reducing mill according to the invention, the bottom of the groove of each of the rolls in each stand has a circular arc shape around the rolling direction line, and therefore the distribution of radial stress exerted on the part of the tube in contact with the bottom of the groove during the rolling process is substantially equal. Consequently, uneven thickness in the radial direction of the tube can be suppressed, and polygon formation can be suppressed at the rolled tube.

The distance between the surface of the roll flange portion and the rolling direction line is longer than the first radius. Therefore, as compared to the case in which the entire groove of the roll is in a circular arc shape around the rolling direction line, the load exerted on the tube in contact with the roll flange portion can be reduced. The distance between the edge of the groove and the rolling direction line is longer than the first radius in the groove of each of the rolls included in the preceding stand, and therefore a gap is formed between the outer circumference of the tube on the inlet side of the stand and the edge of the groove. Therefore, overfilling is unlikely to be generated. In this way, roll edge marks can be suppressed.

The roll flange portion of the groove of the roll preferably has an arch shape in cross section.

In this way, the roll flange portion has an arch shape in cross section, and the part of the tube inserted through the pass shape formed by the grooves of the rolls in contact with the roll flange portion has an arch shape. Therefore, the shape of the tube in cross section is closer to a perfect circle, so that the outer diameter size precision of the rolled tube improves.

In cross section of the groove of the roll, a tangent on an end of the bottom preferably matches a tangent on an end of the roll flange portion on the side of the bottom.

In this way, the bottom of the groove and the roll flange portion are formed smoothly connected, and therefore the part of the tube in contact with the boundary between the bottom and the roll flange portion are smoothly formed without irregularities during rolling process.

The roll flange portion of the groove of the roll preferably has a circular arc having a second radius larger than the first radius in cross section.

In this way, the shape of the rolled tube is closer to that of a perfect circle. Therefore, the outer diameter size precision of the rolled tube improves.

The roll flange portion of the groove of the roll preferably has a straight shape in cross section.

Preferably, the number n of rolls in each stand equals 3 and the circular arc of the bottom of the groove of each of the rolls has a central angle of at least 50°.

When each stand has three rolls, and the arc of the bottom of the groove of each of the rolls has a central angle of at least 50°, the distribution of rolling stress exerted on the outer circumference of the tube is during rolling process unlikely to be uneven. Therefore, polygon formation can more effectively be suppressed. The condition is particularly effective applied to the case in which a tube having a large ratio of thickness/outer diameter is rolled.

Preferably, the number n of rolls in each stand equals 4, and the circular arc of the groove of each of the rolls has a central angle of at least 36°.

When each stand has four rolls, and the arc of the groove bottom of each of the rolls has a central angle of at least 36°, the distribution of rolling stress exerted on the outer circumference of the tube during the rolling process is unlikely to be uneven. Therefore, polygon formation can more effectively be suppressed. The condition is particularly effectively applied to the case in which a tube having a large thickness is rolled.

BEST MODE FOR CARRYING OUT THE INVENTION

Figure 1:
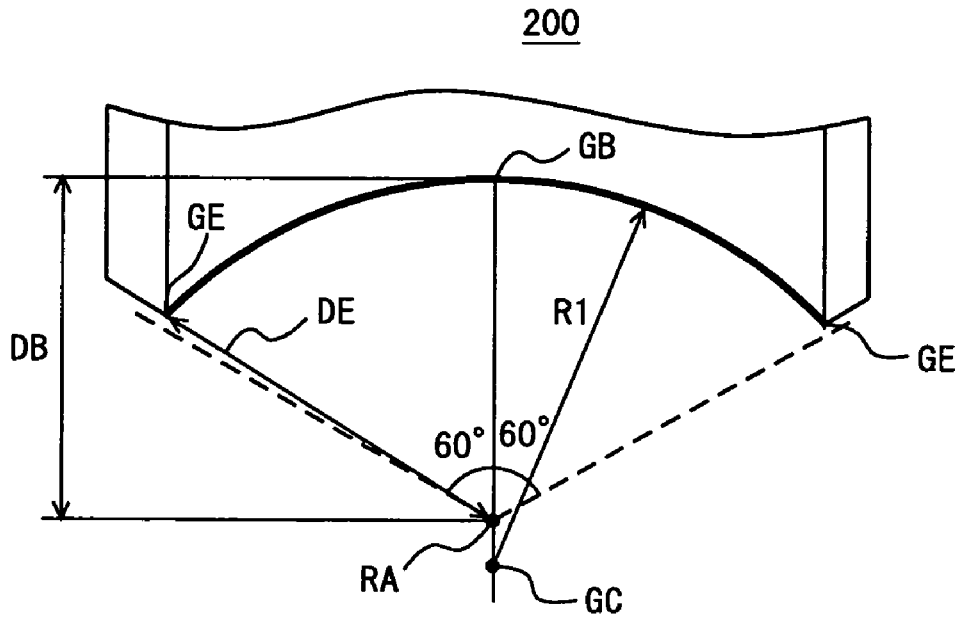
FIG. 1 PRIOR ART
FIG. 1 is a cross sectional view of a roll included in a conventional three-roll reducing mill.

Now, embodiments of the invention will be described in detail with reference to the accompanying drawings, in which the same or corresponding portions are denoted by the same reference characters and their description will equally apply.

Figure 4:
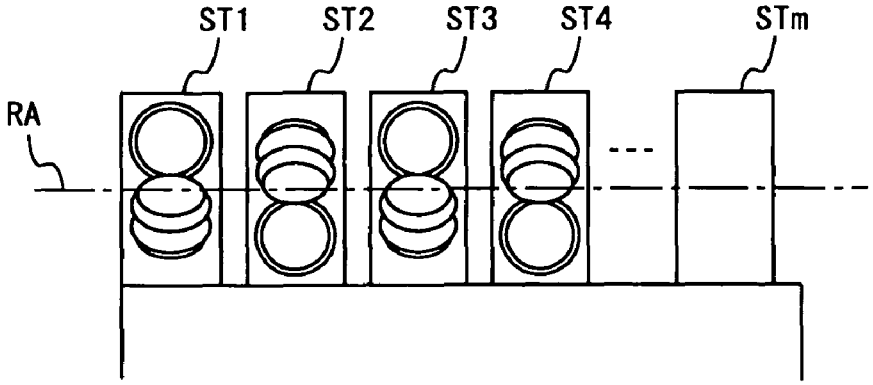
FIG. 4 is a side view of a three-roll reducing mill according to an embodiment of the invention.
Figure 5:
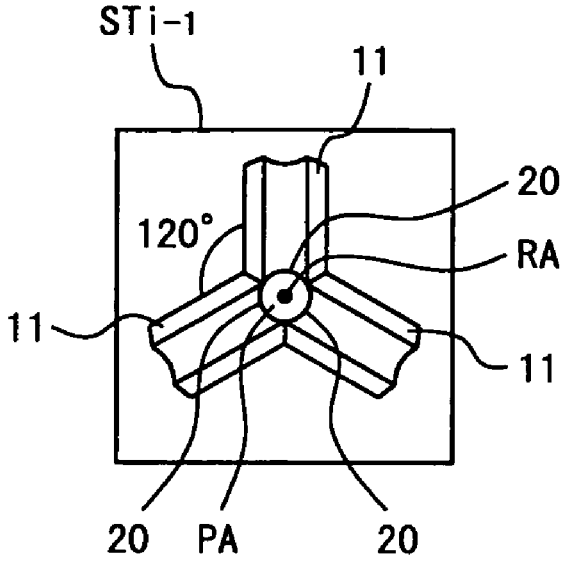
FIG. 5 is a front view of a stand in the reducing mill shown in FIG. 4.
Figure 6:
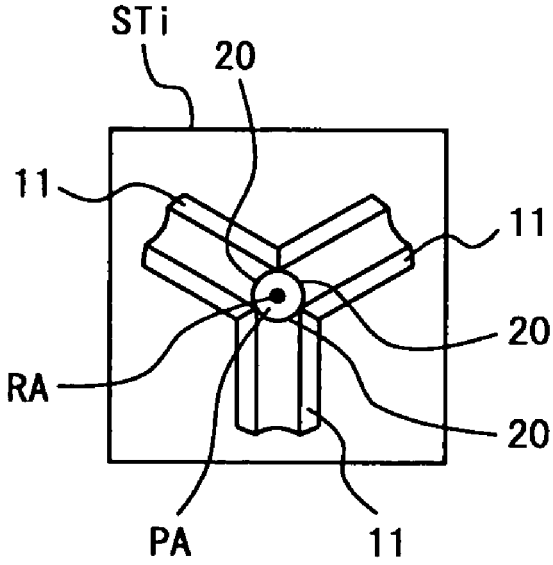
FIG. 6 is a front view of a stand in the stage succeeding the stand shown in FIG. 5.

Referring to FIGS. 4 to 6, the three-roll reducing mill includes a plurality of stands ST1 to STm (m: natural number) disposed along the rolling direction line RA. The stands ST1 to STm each include three rolls 11 disposed in the positions shifted by 120° from one another around the rolling direction line RA. The roll 11 has a groove 20 in an arch shape in cross section, and the grooves 20 of the three rolls 11 form a pass shape PA.

As shown in FIGS. 5 and 6, the three rolls 11 included in the stand STi (i: 2 to m) are disposed shifted by 60° around the rolling direction line RA from the three rolls 11 included in the preceding stand STi−1.

Three rolls in each stand are connected to one another by a bevel gear that is not shown and one of the three rolls 11 is rotated by a motor (not shown), so that all the rolls 11 is rotated.

Figure 7:
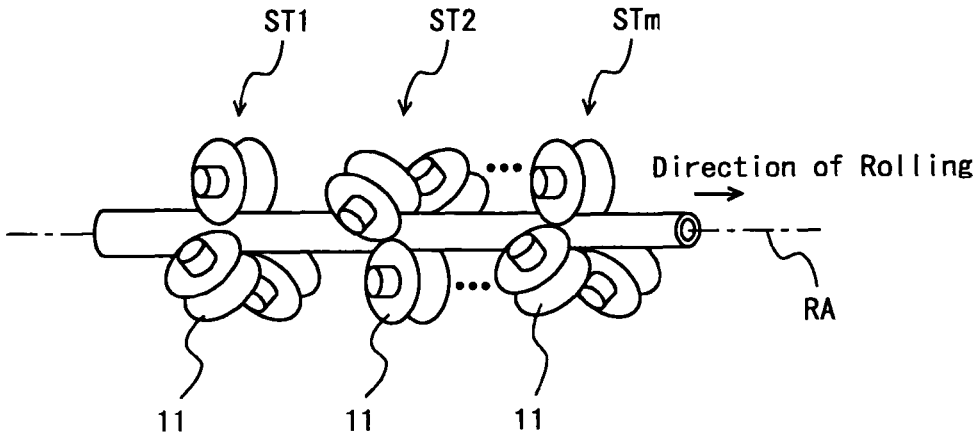
FIG. 7 is a schematic view of the process of rolling a tube using the reducing mill shown in FIG. 4.

The cross sectional area of the pass shape PA formed by the three rolls 11 in each stand is smaller for stands in later stages. Stated differently, the cross sectional area of the pass shape PA is largest in the stand ST1 and smallest in the last stand STm. As shown in FIG. 7, the tube is rolled through from the stands ST1 to STm along the rolling direction line RA.

Figure 8:
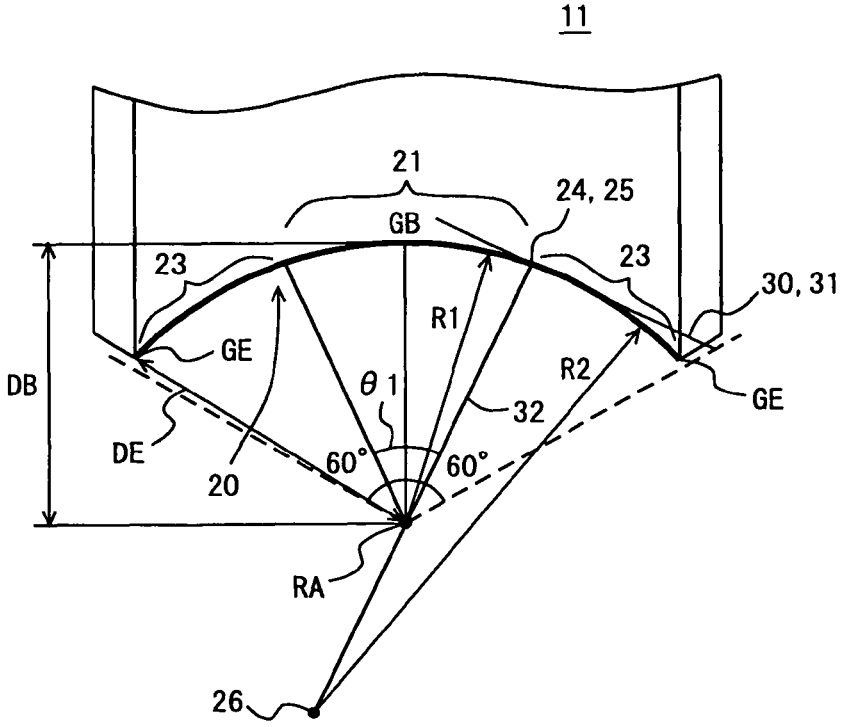
FIG. 8 is a cross sectional view of a roll included in the stands shown in FIGS. 5 and 6.

The rolls 11 included in the stands ST1 to STm−1 excluding the last stand STm each have a groove 20 as shown in FIG. 8. The groove 20 of a roll is in an arch shape in cross section.

The bottom 21 of the groove 20 of the roll 11 in cross section has a circular arc having a radius R1 around the rolling direction line RA. Since the shape of the bottom 21 is a circular arc, the distribution of radial stress exerted on the part of the tube in contact with the bottom 21 of the groove during rolling is equal. Consequently, the tube thickness in the radial direction can be prevented from becoming uneven, and polygon formation can be suppressed at the rolled tube.

A roll flange portion 23 positioned between the bottom 21 and the edge GE of the groove 20 is in a circular arc shape having a radius R2 larger than the radius R1. The distance between any arbitrary point on the surface of the roll flange portion 23 and the rolling direction line RA is longer than the radius R1, and therefore as compared to the case in which the entire groove has a circular arc shape around the rolling direction line RA, the load exerted on the tube in contact with the roll flange portion 23 can be reduced. In this way, roll edge marks can be suppressed.

Figure 9:
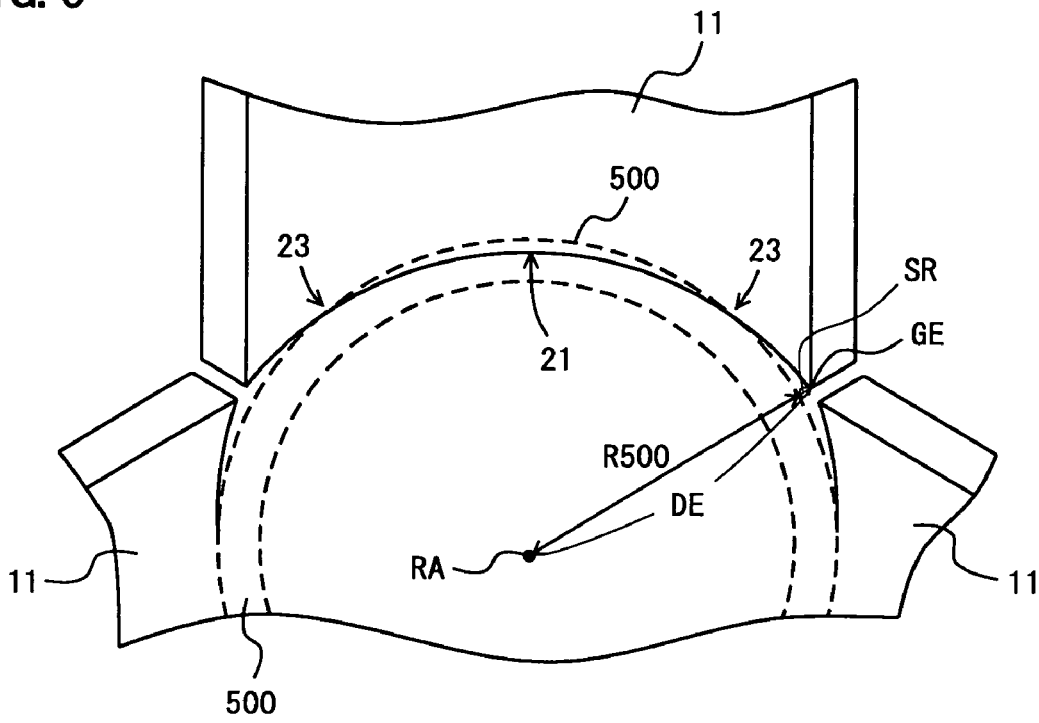
FIG. 9 is a schematic view for use in illustrating the positional relation among the grooves of rolls in each of adjacent stands.

Furthermore, the distance DE between the groove edge GE of the roll 11 included in the stand STi and the rolling direction line RA is larger than the radius R1 in the groove 20 of the roll included in the preceding stand STi−1. Therefore, as shown in FIG. 9, a prescribed relief SR (Side Relief) is formed between the outer circumference of the tube 500 on the stand inlet side and the groove edge GE. The outer radius R500 of the part of the tube 500 in contact with the periphery of the roll groove edge is substantially equal to the radius R1 in the groove of the roll 11 included in the preceding stage stand STi−1. This is because the part is rolled as it is in contact with the groove bottoms 21 of the rolls 11 included in the stand STi−1. The distance DE between the groove edge GE of the roll 11 in the stand STi and the rolling direction line RA is longer than the radius R1 of the roll in the preceding stage STi−1, and therefore a relief SR is formed between the outer circumference of the tube on the stand inlet side and the groove edge GE. This prevents overfilling.

As in the foregoing, the bottom 21 of the groove 20 has a circular arc shape having the radius R1 around the rolling direction line RA, which can reduce polygon formation. In addition, the distance between the surface of the roll flange portion 23 and the rolling direction line RA may be longer than the radius R1, and the distance DB may be larger than the radius R1 in the groove 20 of the roll included in the preceding stand, so that edge flaws can be suppressed.

As shown in FIG. 8, at the groove 20 of the roll 11, a tangent 30 on the end 24 of the bottom 21 matches a tangent 31 on the end 25 of the roll flange portion 23 on the side of the bottom 21. In this way, the center 26 of the circular arc of the roll flange portion 23 is positioned on an extension of the segment 32 on the side of the rolling direction line RA that connects the end 24 of the bottom 21 and the rolling direction line RA. In this way, the bottom 21 is formed smoothly connected with the roll flange portion 23, and therefore the outer surface of the part of the tube in contact with the boundary between the bottom 21 and the roll flange portion 23 does not have irregularities, which improves the outer diameter size precision of the tube.

The central angle θ1 of the bottom 21 is preferably not less than 50°. This is because if the central angle θ1 is smaller, the bottom 21 is narrower, and therefore uneven thickness is more likely to be generated in the circumferential direction of the tube. If the ratio of the thickness relative to the outer diameter size of the tube is large, in other words, if the ratio of thickness/outer diameter is not less than 14%, the central angle θ1 is preferably not less than 50°.

Note that if the distance DE is longer than the radius R1, the upper limit for the central angle θ1 is not specified.

Figure 10:
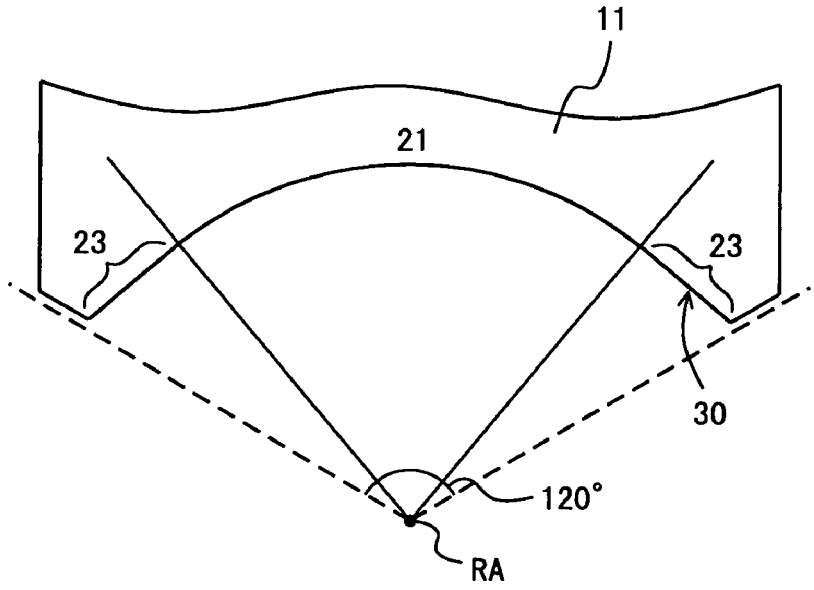
FIG. 10 is a cross sectional view of the groove of a roll different from the groove of the roll shown in FIG. 8.
Figure 11:
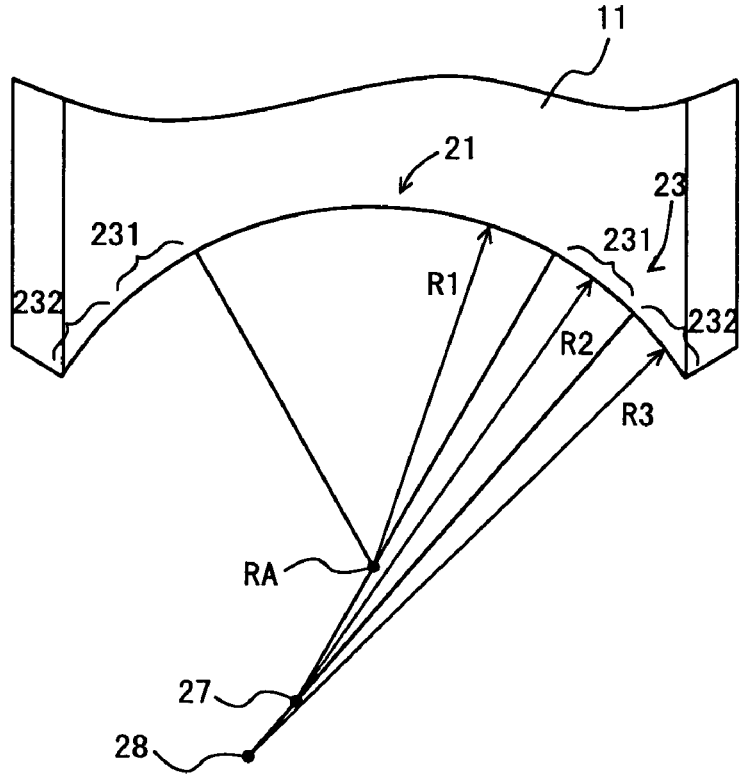
FIG. 11 is a cross sectional view of the groove of another roll different from the groove of the rolls shown in FIGS. 8 and 10.

According to the embodiment, the roll flange portion 23 has a circular arc shape in cross section, but as long as the distance between the surface of the roll flange portion 23 and the rolling direction line RA is longer than the radius R1, the shape may be any other shape. For example, as shown in FIG. 10, the roll flange portion 23 may have a straight shape in cross section. In this case, the roll flange portion 23 preferably matches the tangent 30 on the end 24 of the bottom 21. In this way, the bottom 21 and the roll flange portion 23 may be formed smoothly connected. The roll flange portion 23 is in a circular arch shape in cross section and may have at least two radii of curvature. As shown in FIG. 11, for example, the roll flange portion 23 may have a first circular arc part 231 having a center 27 on an extension of a segment on the side of the rolling direction line RA connecting the end of the bottom and the rolling direction line RA and having a radius R2, and a second circular arc part 232 having a center 28 on an extension of a segment on the side of the center 27 connecting the end of the arc part 231 and the center 27 and having a radius R3 larger than the radius R2.

Figure 12:
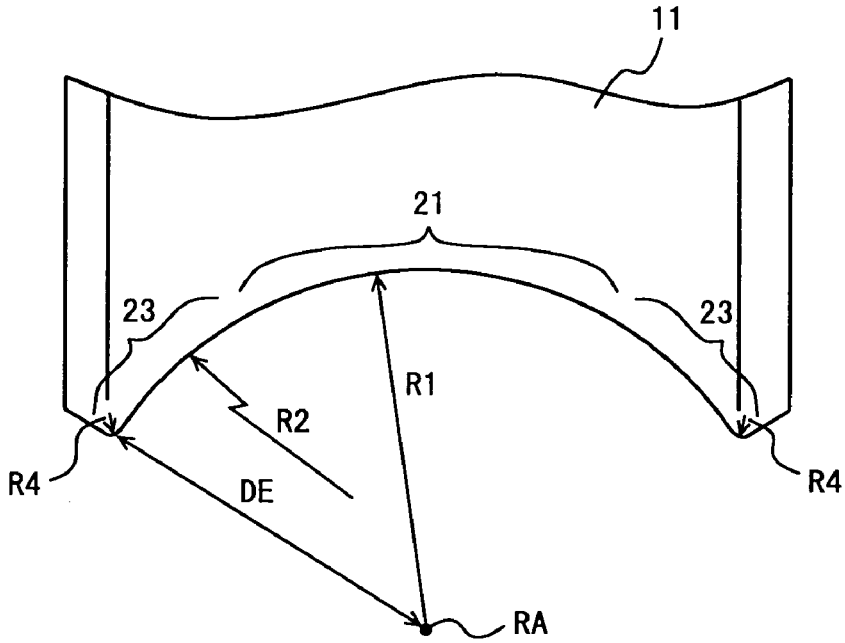
FIG. 12 is a sectional view of the groove of a further roll different from the rolls shown in FIGS. 8, 10, and 11.

As shown in FIG. 12, a corner radius R4 may be provided at the edge of the groove 20. In this case, the distance DE between any arbitrary point on the circular arc with the corner radius R4 and the rolling direction line RA is longer than the radius R1 in the grooves of the rolls included in the preceding stand.

Note that among the plurality of stands ST in the reducing mill, the grooves of the rolls included in the last stand STm forms a pass in the shape of a circle. In short, the entire groove of the roll has a circular arc shape around the rolling direction line RA in cross section. This is because the reduction in the last stand STm is small, and therefore roll edge marks are not caused if the entire groove is in a circular arc shape. Note that grooves of the rolls included in the last stand STm may have the same shape as that of the groove 20 described above.

The reducing mill described above has three rolls in each stand, while the invention may be applied to a reducing mill having more than three rolls. Now, a four-roll reducing mill will be described.

As with the three-roll reducing mill, the four-roll reducing mill includes a plurality of stands ST1 to STm disposed along the rolling direction line RA.

Figure 13:
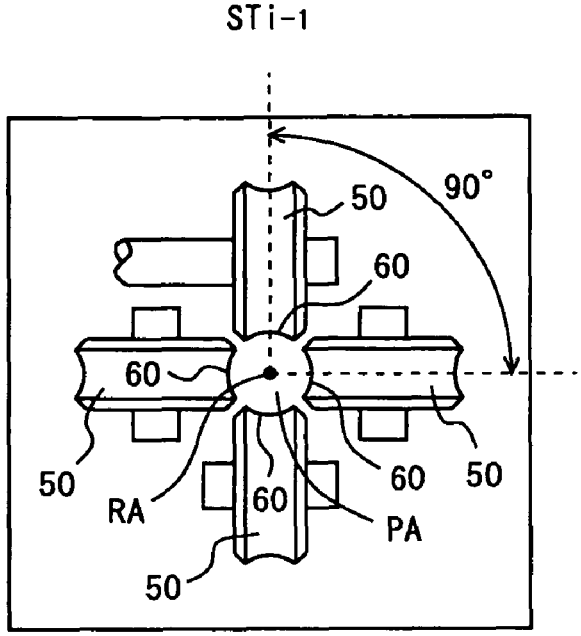
FIG. 13 is a front view of a stand included in a four-roll reducing mill according to an embodiment of the invention.
Figure 14:
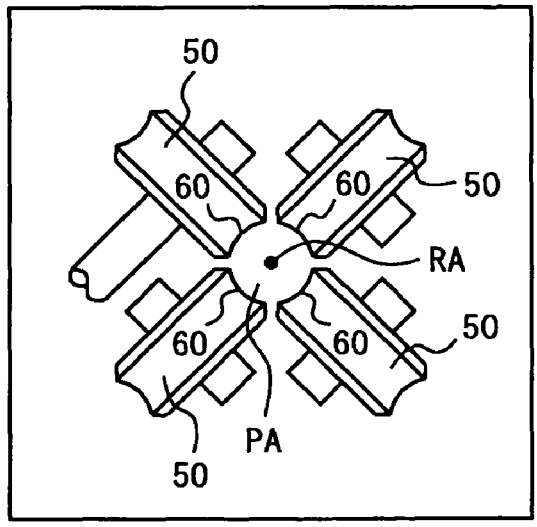
FIG. 14 is a front view of a stand in the stage succeeding the stand shown in FIG. 13.

As shown in FIGS. 13 and 14, the plurality of stands STi (i: 2 to m) each include four rolls 50 disposed at intervals of 90° around the rolling direction line RA. The rolls 50 each has a groove 60 in an arch shape in cross section and the grooves 60 of the four rolls 50 form a pass shape PA.

The four rolls 50 included in the stand STi are disposed shifted by 45° around the rolling direction line RA from the four rolls 50 included in the preceding stand STi−1.

Figure 15:
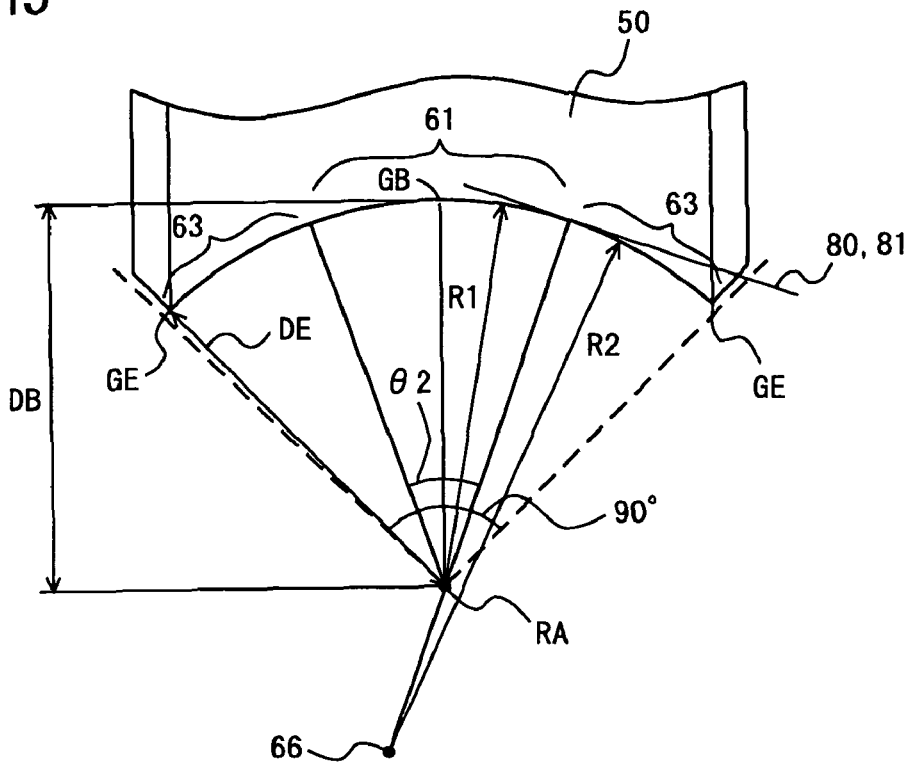
FIG. 15 is a cross sectional view of the groove of a roll included in the stand shown in FIGS. 13 and 14.

The grooves 60 of the rolls 50 included in the stands ST1 to STm−1 excluding the last stand STm have an arch shape. Referring to FIG. 15, the shape of the groove 60 is the same as that of the groove 20 of the roll 12 shown in FIG. 8.

More specifically, the bottom 61 of the groove 60 forms a circular arc having a radius R1 around the rolling direction line RA. In this way, polygon formation can be suppressed. A roll flange portion 63 forms an arc having a radius R2 larger than the radius R1. More specifically, the distance between the surface of the roll flange portion 63 and the rolling direction line RA is longer than the radius R1. The distance DE between the edge GE of the groove 60 of the roll included in the stand STi and the rolling direction line RA is longer than the radius R1 in the groove of the roll included in the stand STi−1. In this way, roll edge marks can be suppressed. Note that a tangent 80 on the end of the bottom 61 matches a tangent 81 on the end of the roll flange portion 63 on the side of the bottom 61. In this case, the center 66 of the circular arc of the roll flange portion 63 is positioned on an extension of a segment on the side of the rolling direction line RA that connects the end of the bottom 61 and the rolling direction line RA. The bottom 61 is formed smoothly connected with the roll flange portion 63, and therefore no irregularities is formed on the outer surface of the part of the tube in contact with the boundary between the bottom 61 and the roll flange portion 63, which improves the outer diameter size precision of the tube.

The central angle θ2 of the circular arc of the bottom 61 of the groove 60 of the roll 50 is preferably not less than 36°. When the thickness/outer diameter size of the tube to be rolled is 16% or more in particular, the central angle θ2 is set to be not less than 36°, so that polygon formation can effectively be prevented. Note that if the distance DE is longer than the radius R1, the upper limit for the central angle θ2 is not specified.

The invention has been described with reference to the three-roll and four-roll reducing mills as examples, while the reducing mill according to the invention cannot be applied to a two-roll reducing mill. In the two-roll reducing mill, the flow of a material (tube) to be subjected to rolling process spreads in the widthwise direction more than the case of the three-roll or four-roll mill. In short, the two-roll reducing mill is more likely to suffer from overfilling. Therefore, the use of rolls having a groove shape according to the invention for the mill may cause roll edge marks.

Example 1

Using a three-roll sizer including seven stands ST1 to ST7 each having rolls in shapes shown in Table 1, a seamless steel tube having an outer diameter of 300 mm was rolled, and the rolled tube was examined for the presence of polygon formation and roll edge marks.

TABLE 1

| | type | stand No. | R1 (mm) | R2 (mm) | θ1 (°) | DE (mm) | DB (mm) | $DE_i$-$DB_{i-1}$ | reduction (%) | R1/DB |
|---|---|---|---|---|---|---|---|---|---|---|
| inventive example | T1 | ST1 | 136.40 | 317.81 | 50 | 151.51 | 136.40 | positive | 4.0 | 1.00 |
| | | ST2 | 130.95 | 305.11 | 50 | 145.45 | 130.95 | positive | 4.0 | 1.00 |
| | | ST3 | 125.70 | 292.88 | 50 | 139.62 | 125.70 | positive | 4.0 | 1.00 |
| | | ST4 | 120.70 | 281.23 | 50 | 134.07 | 120.70 | positive | 4.0 | 1.00 |
| | | ST5 | 115.85 | 269.93 | 50 | 128.68 | 115.85 | positive | 4.0 | 1.00 |
| | | ST6 | 116.59 | 127.00 | 50 | 118.31 | 116.59 | positive | 4.0 | 1.00 |
| | | ST7 | 116.59 | 116.59 | 50 | 116.59 | 116.59 | — | 0.7 | 1.00 |
| | T2 | ST1 | 144.00 | 100000 | 84 | 151.23 | 144.00 | positive | 1.5 | 1.00 |
| | | ST2 | 138.50 | 1801 | 84 | 144.89 | 138.50 | positive | 4.0 | 1.00 |
| | | ST3 | 133.00 | 1729 | 84 | 139.14 | 133.00 | positive | 4.0 | 1.00 |
| | | ST4 | 127.67 | 1660 | 84 | 133.56 | 127.67 | positive | 4.0 | 1.00 |
| | | ST5 | 122.60 | 1594 | 84 | 128.25 | 122.60 | positive | 4.0 | 1.00 |
| | | ST6 | 117.65 | 1529 | 84 | 123.08 | 117.65 | positive | 4.0 | 1.00 |
| | | ST7 | 116.59 | 144 | 84 | 117.66 | 116.59 | — | 2.7 | 1.00 |
| | T3 | ST1 | 135.82 | 258.06 | 40 | 152.00 | 135.82 | positive | 4.0 | 1.00 |
| | | ST2 | 130.40 | 247.76 | 40 | 145.93 | 130.40 | positive | 4.0 | 1.00 |
| | | ST3 | 125.20 | 237.88 | 40 | 140.11 | 125.20 | positive | 4.0 | 1.00 |
| | | ST4 | 120.22 | 228.41 | 40 | 134.54 | 120.22 | positive | 4.0 | 1.00 |
| | | ST5 | 115.44 | 219.33 | 40 | 129.19 | 115.44 | positive | 4.0 | 1.00 |
| | | ST6 | 116.59 | 125.00 | 40 | 118.42 | 116.59 | positive | 4.0 | 1.00 |
| | | ST7 | 116.59 | 116.59 | 40 | 116.59 | 116.59 | — | 0.8 | 1.00 |
| comparative example | T4 | ST1 | 142.88 | 156.31 | 50 | 145.09 | 142.88 | negative | 4.0 | 1.00 |
| | | ST2 | 137.17 | 150.06 | 50 | 139.29 | 137.17 | negative | 4.0 | 1.00 |
| | | ST3 | 131.68 | 144.06 | 50 | 133.72 | 131.68 | negative | 4.0 | 1.00 |
| | | ST4 | 126.41 | 138.29 | 50 | 128.37 | 126.41 | negative | 4.0 | 1.00 |
| | | ST5 | 121.35 | 132.76 | 50 | 123.23 | 121.35 | negative | 4.0 | 1.00 |
| | | ST6 | 116.52 | 127.47 | 50 | 118.33 | 116.52 | negative | 4.0 | 1.00 |
| | | ST7 | 116.59 | 116.59 | 50 | 116.59 | 116.59 | — | 0.7 | 1.00 |
| | T5 | ST1 | 151.37 | 296.68 | 60 | 152.01 | 135.83 | positive | 4.0 | 1.11 |
| | | ST2 | 144.32 | 282.87 | 60 | 145.68 | 130.65 | positive | 4.0 | 1.10 |
| | | ST3 | 138.47 | 271.40 | 60 | 139.84 | 125.45 | positive | 4.0 | 1.10 |
| | | ST4 | 133.85 | 262.34 | 60 | 134.47 | 120.20 | positive | 4.0 | 1.11 |
| | | ST5 | 126.96 | 248.84 | 60 | 128.70 | 115.78 | positive | 4.0 | 1.10 |
| | | ST6 | 128.25 | 102.30 | 60 | 118.27 | 116.59 | positive | 4.0 | 1.10 |
| | | ST7 | 116.59 | 116.59 | 60 | 116.59 | 116.59 | — | 0.7 | 1.00 |
| | T6 | ST1 | 163.88 | — | — | 150.15 | 138.46 | positive | 3.8 | 1.18 |
| | | ST2 | 157.54 | — | — | 143.82 | 133.10 | positive | 4.0 | 1.18 |
| | | ST3 | 151.20 | — | — | 138.04 | 127.75 | positive | 4.0 | 1.18 |
| | | ST4 | 145.12 | — | — | 132.48 | 122.60 | positive | 4.0 | 1.18 |

TABLE 1-continued

| type | stand No. | R1 (mm) | R2 (mm) | θ1 (°) | DE (mm) | DB (mm) | $DE_i$-$DB_{i-1}$ | reduction (%) | R1/DB |
|---|---|---|---|---|---|---|---|---|---|
| | ST5 | 139.28 | — | — | 127.15 | 117.67 | positive | 4.0 | 1.18 |
| | ST6 | 120.51 | — | — | 118.49 | 116.59 | positive | 4.0 | 1.03 |
| | ST7 | 116.59 | — | — | 116.59 | 116.59 | — | 0.8 | 1.00 |
| T7 | ST1 | 150.22 | — | — | 145.92 | 142.00 | negative | 4.0 | 1.06 |
| | ST2 | 144.19 | — | — | 140.06 | 136.30 | negative | 4.0 | 1.06 |
| | ST3 | 138.40 | — | — | 134.44 | 130.83 | negative | 4.0 | 1.06 |
| | ST4 | 132.84 | — | — | 129.04 | 125.57 | negative | 4.0 | 1.06 |
| | ST5 | 127.51 | — | — | 123.86 | 120.53 | negative | 4.0 | 1.06 |
| | ST6 | 119.46 | — | — | 117.99 | 116.59 | negative | 4.0 | 1.02 |
| | ST7 | 116.59 | — | — | 116.59 | 116.59 | — | 0.6 | 1.00 |

The "type" column in Table 1 indicates the sizer subjected to the examination. The "stand No." refers to any of stands ST1 to ST7 included in each type of reducing sizers.

The sizers of types T1 to T4 each used rolls 11 in the shape shown in FIG. 8. The radii R1 and R2, the central angle θ1, the distance DE, and the distance DB between the rolling direction line RA and the center of bottom GB in the groove 20 of each of the rolls 11 included in each of the stands ST1 to ST7 were as shown in Table 1. The grooves of the rolls for use in the last stand ST7 for the sizers of types T1, T3, and T4 are each in a circular arc shape having a radius R1 from the rolling direction line RA. More specifically, the pass shape formed by the grooves of the rolls in the stand ST7 is in the shape of a circle.

Note that the "$DE_i$-$DB_{i-1}$" column in Table 1 indicates whether the result of subtraction of the distance DB in each of the rolls included in the preceding stand STi−1 from the distance DE in each of the rolls included in the stand STi is positive or negative. Note that in the "$DE_i$-$DB_{i-1}$" section of each of the rolls included in the stand ST1 indicates whether the result of subtraction of the outer radius of the seamless steel tube (150 mm) from the distance DE is negative or positive.

The "reduction" column indicates the reduction (%) in each stand produced by the following Expression (1). The "R1/DB" column indicates the ratio of the radius R1 relative to the distance DB of each of the rolls included in each stand.

$$\text{Reduction}(\%)=((\text{major axis+minor axis of pass shape of stand } STi-1)-(\text{major axis+minor axis of pass shape of stand } STi))/(\text{major axis+minor axis of pass shape of stand } STi-1)\times 100 \quad (1)$$

Figure 3:
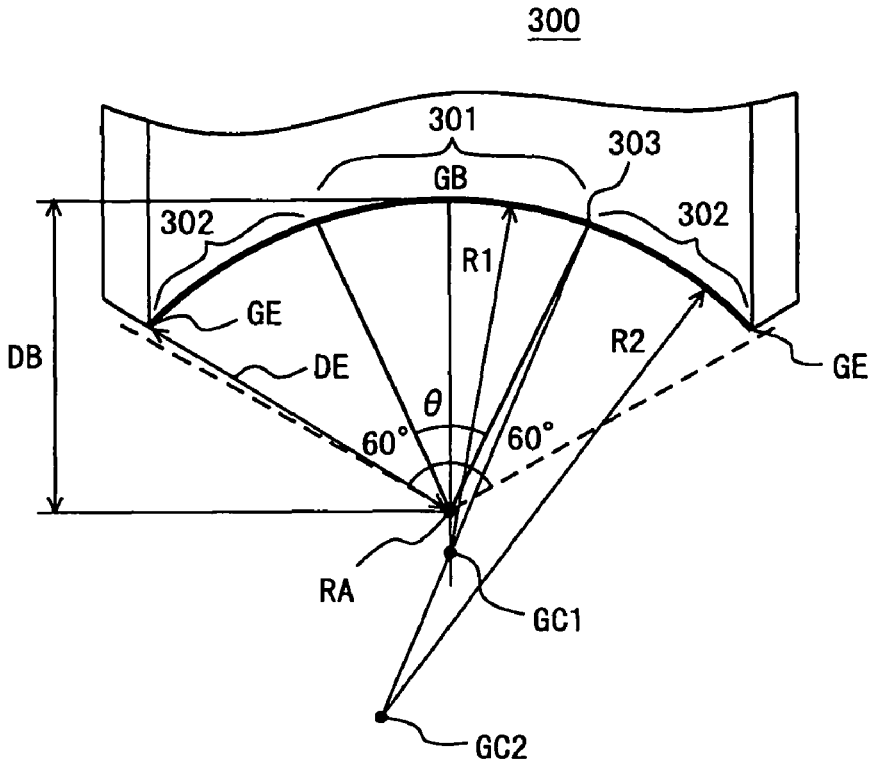
FIG. 3 PRIOR ART
FIG. 3 is a cross sectional view of a conventional roll different from the roll shown in FIG. 1.

For the sizer of type T5, the rolls 300 as shown in FIG. 3 were used. Therefore, in the rolls in the stands ST1 to ST6, the radius R1/distance DB ratio is larger than 1. For the sizers of types T6 and T7, the rolls 200 as shown in FIG. 1 were used. The grooves of the rolls used in the last stand ST7 in the sizers of types T5 to T7 were each in an arc shape having a radius R1 from the rolling direction line RA.

1. Examination for Polygon Formation and Roll Edge Marks

By using the sizers of types T1, T2, and T4 to T7, a seamless steel tube having an outer diameter of 300 mm and a thickness of 25 mm was subjected to hot rolling. More specifically, one seamless steel tube at temperatures from 850° C. to 900° C. on the outlet side of the sizers of the types was rolled.

Figure 2:
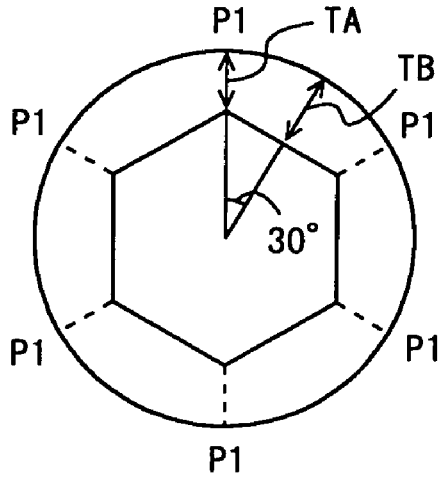
FIG. 2 PRIOR ART
FIG. 2 is a cross sectional view of a tube having polygon formation.

The elongated seamless steel tube was examined for the presence/absence of polygon formation and roll edge marks. More specifically, one cross section was sampled in the longitudinal center of the seamless steel tube. The sampled cross section was measured for thickness using a micrometer. More specifically, referring to FIG. 2, in the sample, the thickness TA of a part P1 in contact with the bottom of the groove of each of the rolls in each of the stands of the sizer and the thickness TB in a location shifted by 30° around the rolling direction line from the measuring position of the thickness TA were measured. The average values $TA_{ave}$ and $TB_{ave}$ of the measured values TA and TB were obtained, and the polygon formation ratio PF (%) was obtained from Expression (2):

$$PF=(TB_{ave}-TA_{ave})/\{(TB_{ave}+TA_{ave})/2\}\times 100(\%) \quad (2)$$

When the obtained polygon formation ratio PF was not less than 3.0%, it was determined that internal angulation was caused.

Meanwhile, roll edge marks were visually examined. More specifically, the occurrence of roll edge mark was determined based on the presence of overfilling in the longitudinal direction of the seamless steel tube.

The result of examination is given in Table 2.

TABLE 2

| type | polygon formation ratio PF(%) | roll edged marks |
|---|---|---|
| T1 | 0.7 | absent |
| T2 | 0.3 | absent |
| T4 | 0.5 | present |
| T5 | 3.9 | absent |
| T6 | 6.2 | absent |
| T7 | 2.9 | present |

As shown in Table 2, pipes or tubes rolled using the sizers of types T1 and T2 according to inventive examples were free from the polygon formation and roll edge marks. Meanwhile, with the sizer of type T4, since the result of $DE_i$-$DB_{i-1}$ was negative, roll edge marks considered to have been caused by overfilling were observed. With the sizers of types T5 and T6, R1/DB is larger than 1 and therefore polygon formation was generated. With the sizer of type T7, since the result of $DE_i$-$DB_{i-1}$ was negative, there were roll edge marks.

2. Examination for Polygon Formation Using Tubes Different in Thickness

Seamless steel tubes having outer diameters and thickness shown in Table 3 were rolled using sizers of the types shown in Table 3.

TABLE 3

| | metal tube before rolling | | | | polygon |
|---|---|---|---|---|---|
| test No. | outer diameter (mm) | thickness (mm) | thickness/outer diameter (%) | roll group type | formation ratio PF (%) |
| 1 | 300 | 15 | 5.0 | T1 | 0.5 |
| 2 | 300 | 15 | 5.0 | T2 | 0.3 |

TABLE 3-continued

| test No. | metal tube before rolling: outer diameter (mm) | thickness (mm) | thickness/outer diameter (%) | roll group type | polygon formation ratio PF (%) |
|---|---|---|---|---|---|
| 3 | 300 | 15 | 5.0 | T3 | 0.9 |
| 4 | 300 | 43 | 14.3 | T1 | 0.8 |
| 5 | 300 | 43 | 14.3 | T2 | 0.6 |
| 6 | 300 | 43 | 14.3 | T3 | 1.8 |

The temperature of the seamless tubes during the rolling was from 850° C. to 1000° C. on the sizer outlet side. The rolled tubes were examined for polygon formation ratio by the same method as that described in the above section 1.

As shown in Table 3, the polygon formation ratios for all the test numbers were less than 3.0%. However, when a seamless steel tube having a thickness of 43 mm was rolled, and the polygon formation ratio of the tube rolled using a sizer of type T3 whose central angle θ1 was less than 50° was higher than the polygon formation ratios of the tubes rolled using the sizers of types T1 and T2. Stated differently, when a tube having a ratio of thickness/outer diameter more than 14% was rolled, and the central angle θ1 of the bottom of the groove of the roll was not less than 50°, the occurrence of polygon formation was more efficiently suppressed. Note that roll edge marks were not generated for any of the test numbers.

Example 2

Using a four-roll sizer including eight stands ST1 to ST8 having rolls in shapes shown in Table 4, a seamless steel tube was rolled, and the tube was examined for polygon formation and roll edge marks.

TABLE 4

| | roll group type | stand No. | R1 (mm) | R2 (mm) | θ2 (°) | DE (mm) | DB (mm) | $DE_i$-$DB_{i-1}$ | draft (%) | R1/DB |
|---|---|---|---|---|---|---|---|---|---|---|
| inventive example | T8 | ST1 | 11.34 | 100.00 | 36 | 12.51 | 11.34 | positive | 4.5 | 1.00 |
| | | ST2 | 10.86 | 65.17 | 36 | 11.88 | 10.86 | positive | 4.5 | 1.00 |
| | | ST3 | 10.37 | 62.24 | 36 | 11.34 | 10.37 | positive | 4.5 | 1.00 |
| | | ST4 | 9.91 | 59.44 | 36 | 10.83 | 9.91 | positive | 4.5 | 1.00 |
| | | ST5 | 9.46 | 56.76 | 36 | 10.35 | 9.46 | positive | 4.5 | 1.00 |
| | | ST6 | 9.04 | 54.21 | 36 | 9.88 | 9.04 | positive | 4.5 | 1.00 |
| | | ST7 | 9.00 | 10.14 | 36 | 9.11 | 9.00 | positive | 4.5 | 1.00 |
| | | ST8 | 9.00 | — | — | 9.00 | 9.00 | — | 0.6 | 1.00 |
| | T9 | ST1 | 11.90 | 100000.00 | 54 | 12.50 | 11.90 | positive | 2.4 | 1.00 |
| | | ST2 | 11.37 | 909.44 | 54 | 11.90 | 11.37 | positive | 4.5 | 1.00 |
| | | ST3 | 10.86 | 868.54 | 54 | 11.36 | 10.86 | positive | 4.5 | 1.00 |
| | | ST4 | 10.37 | 829.48 | 54 | 10.85 | 10.37 | positive | 4.5 | 1.00 |
| | | ST5 | 9.90 | 792.18 | 54 | 10.37 | 9.90 | positive | 4.5 | 1.00 |
| | | ST6 | 9.46 | 756.55 | 54 | 9.90 | 9.46 | positive | 4.5 | 1.00 |
| | | ST7 | 9.03 | 722.48 | 54 | 9.45 | 9.03 | positive | 4.5 | 1.00 |
| | | ST8 | 9.00 | — | — | 9.00 | 9.00 | — | 2.8 | 1.00 |
| | T10 | ST1 | 11.39 | 35.00 | 30 | 12.50 | 11.39 | positive | 4.4 | 1.00 |
| | | ST2 | 10.88 | 32.64 | 30 | 11.88 | 10.88 | positive | 4.5 | 1.00 |
| | | ST3 | 10.39 | 31.18 | 30 | 11.35 | 10.39 | positive | 4.5 | 1.00 |
| | | ST4 | 9.93 | 29.78 | 30 | 10.84 | 9.93 | positive | 4.5 | 1.00 |
| | | ST5 | 9.48 | 28.45 | 30 | 10.35 | 9.48 | positive | 4.5 | 1.00 |
| | | ST6 | 9.06 | 27.18 | 30 | 9.89 | 9.06 | positive | 4.5 | 1.00 |
| | | ST7 | 9.00 | 10.20 | 30 | 9.14 | 9.00 | positive | 4.5 | 1.00 |
| | | ST8 | 9.00 | — | — | 9.00 | 9.00 | — | 0.8 | 1.00 |
| comparative example | T11 | ST1 | 11.81 | 14.80 | 36 | 12.06 | 11.81 | negative | 4.5 | 1.00 |
| | | ST2 | 11.32 | 13.02 | 36 | 11.48 | 11.32 | negative | 4.5 | 1.00 |
| | | ST3 | 10.82 | 12.44 | 36 | 10.96 | 10.82 | negative | 4.5 | 1.00 |
| | | ST4 | 10.33 | 11.88 | 36 | 10.47 | 10.33 | negative | 4.5 | 1.00 |
| | | ST5 | 9.86 | 11.34 | 36 | 10.00 | 9.86 | negative | 4.5 | 1.00 |
| | | ST6 | 9.42 | 10.83 | 36 | 9.55 | 9.42 | negative | 4.5 | 1.00 |
| | | ST7 | 9.00 | 10.20 | 36 | 9.11 | 9.00 | negative | 4.5 | 1.00 |
| | | ST8 | 9.00 | 9.00 | 36 | 9.00 | 9.00 | — | 0.6 | 1.00 |
| | T12 | ST1 | 12.55 | 112.96 | 45 | 12.50 | 11.41 | positive | 4.3 | 1.10 |
| | | ST2 | 11.99 | 107.91 | 45 | 11.89 | 10.90 | positive | 4.5 | 1.10 |
| | | ST3 | 11.45 | 103.09 | 45 | 11.36 | 10.41 | positive | 4.5 | 1.10 |
| | | ST4 | 10.94 | 98.48 | 45 | 10.85 | 9.95 | positive | 4.5 | 1.10 |
| | | ST5 | 10.45 | 94.09 | 45 | 10.37 | 9.50 | positive | 4.5 | 1.10 |
| | | ST6 | 9.99 | 89.89 | 45 | 9.90 | 9.08 | positive | 4.5 | 1.10 |
| | | ST7 | 9.85 | 10.50 | 45 | 9.22 | 8.95 | positive | 4.5 | 1.10 |
| | | ST8 | 9.00 | — | — | 9.00 | 9.00 | — | 1.0 | 1.00 |
| | T13 | ST1 | 13.73 | — | — | 12.54 | 11.60 | positive | 3.4 | 1.18 |
| | | ST2 | 13.11 | — | — | 11.98 | 11.08 | positive | 4.5 | 1.18 |
| | | ST3 | 12.53 | — | — | 11.44 | 10.58 | positive | 4.5 | 1.18 |
| | | ST4 | 11.97 | — | — | 10.93 | 10.11 | positive | 4.5 | 1.18 |
| | | ST5 | 11.43 | — | — | 10.44 | 9.66 | positive | 4.5 | 1.18 |
| | | ST6 | 10.92 | — | — | 9.97 | 9.22 | positive | 4.5 | 1.18 |
| | | ST7 | 10.65 | — | — | 9.73 | 9.00 | positive | 2.4 | 1.18 |
| | | ST8 | 9.00 | — | — | 9.00 | 9.00 | — | 3.9 | 1.00 |
| | T14 | ST1 | 12.46 | — | — | 12.11 | 11.78 | negative | 4.5 | 1.06 |
| | | ST2 | 11.90 | — | — | 11.56 | 11.25 | negative | 4.5 | 1.06 |
| | | ST3 | 11.37 | — | — | 11.04 | 10.74 | negative | 4.5 | 1.06 |
| | | ST4 | 10.85 | — | — | 10.55 | 10.26 | negative | 4.5 | 1.06 |
| | | ST5 | 10.37 | — | — | 10.07 | 9.80 | negative | 4.5 | 1.06 |
| | | ST6 | 9.90 | — | — | 9.62 | 9.36 | negative | 4.5 | 1.06 |

TABLE 4-continued

| roll group type | stand No. | R1 (mm) | R2 (mm) | θ2 (°) | DE (mm) | DB (mm) | $DE_i$-$DB_{i-1}$ | draft (%) | R1/DB |
|---|---|---|---|---|---|---|---|---|---|
| | ST7 | 9.27 | — | — | 9.13 | 9.00 | negative | 4.5 | 1.03 |
| | ST8 | 9.00 | — | — | 9.00 | 9.00 | — | 0.7 | 1.00 |

The items in Table 4 are the same as those in Table 1. Rolls 50 in the shape shown in FIG. 15 were used for sizers of types T8 to T11.

Figure 16:
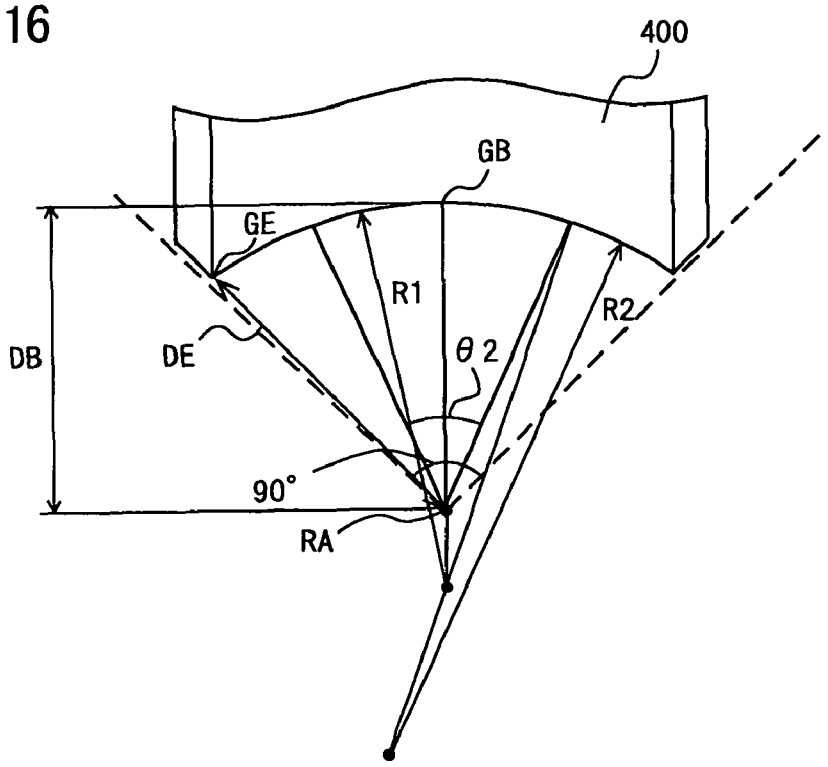
FIG. 16 is a cross sectional view of a roll used according to Example 2.
Figure 17:
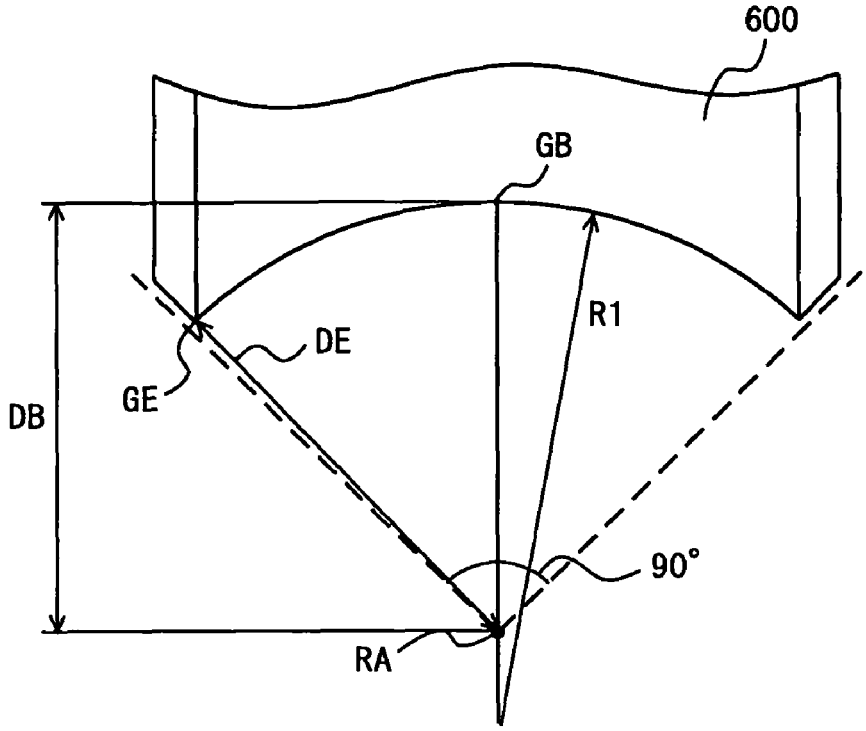
FIG. 17 is a cross sectional view of a roll different from the roll shown in FIG. 16.

Rolls 400 in the shape shown in FIG. 16 were used for the sizer of type T12. The shape of the groove of the roll 400 was the same as that of the roll 300 in FIG. 3. In the rolls in the stands ST1 to ST7, the radius R1/distance DB was larger than 1. Rolls 600 in the shape shown in FIG. 17 were used for the sizer of types T13 and T14. The shape of the groove of the roll 600 was the same as that of the roll 200 in FIG. 1.

The grooves of the rolls for use in the last stand ST8 in the sizers of types T8 to T14 were in a circular arc shape having a radius R1 around the rolling direction line RA. The pass shape formed by the rolls was a circle around the rolling direction line RA.

1. Examination for Polygon Formation and Roll Edge Marks

With the sizers of types T8, T9, and T11 to T14, one high frequency ERW (Electric Resistance Welded) tube having an outer diameter of 25 mm and a thickness of 2 mm was subjected to cold rolling. In order to eliminate the hardness difference between the welded part of the ERW tube and the base material, the ERW tube was thermally treated.

Figure 18:
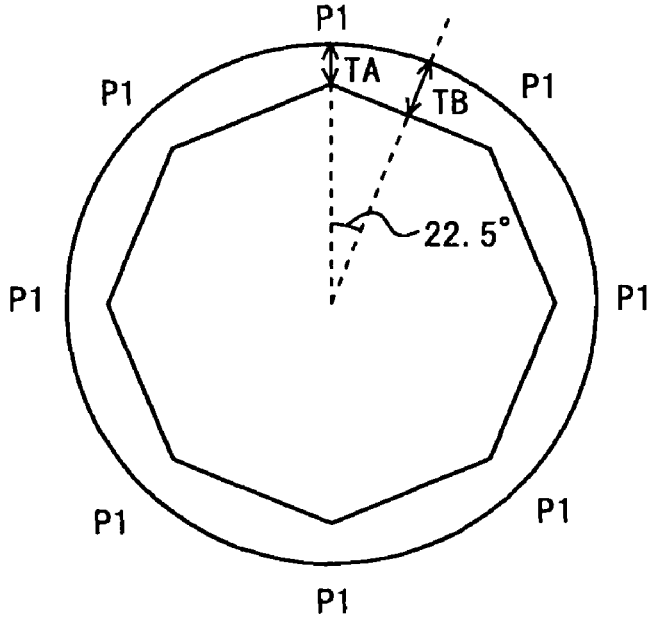
FIG. 18 is a schematic view for use in illustrating a method of measuring polygon formation in Example 2.

After the rolling, the polygon formation ratio of the ERW tube was obtained similarly to Example 1. As shown in FIG. 18, the thickness TA of the part P1 of the sample in contact with the bottom of each of the grooves of the rolls in each stand of the sizer and the thickness TB of the part in a position shifted by 22.50 around the rolling direction line RA from the measurement position of the thickness TA were measured, and the polygon formation ratio PF (%) represented by Expression 2 was obtained. Similarly to Example 1, when the polygon formation ratio PF was not less than 3.0%, it was determined that polygon formation was generated. The presence/absence of roll edge marks were determined by the same method as that according to Example 1.

The examination result is shown in Table 5.

TABLE 5

| type | polygon formation ratio PF (%) | roll edge marks |
|---|---|---|
| T8 | 0.7 | absent |
| T9 | 0.4 | absent |
| T11 | 0.6 | present |
| T12 | 4.1 | absent |
| T13 | 5.5 | absent |
| T14 | 2.7 | present |

ERW tubes rolled through the sizers of types T8 and T9 according to the inventive examples did not have polygon formation and roll edge marks. Meanwhile with the sizer of type T11, the result of $DE_i$-$DB_{i-1}$ was negative, and therefore there were roll edge marks. With the sizers of types T12 and T13, R1/B was larger than 1, and therefore polygon formation was caused. With the sizer of type T14, the result of $DE_i$-$DB_{i-1}$ was negative, and therefore there were roll edge marks.

2. Examination of Tubes Different in Thickness for Polygon Formation

ERW tubes having outer diameters and thickness shown in Table 6 were rolled through sizers of types shown in Table 6. The ERW tubes were thermally treated in advance as with the case described in the above section 1. The polygon formation ratio was obtained for the rolled ERW tubes.

TABLE 6

| test No. | metal tube before rolling: outer diameter (mm) | thickness (mm) | thickness/outer diameter (%) | roll group type | polygon formation ratio PF (%) |
|---|---|---|---|---|---|
| 7 | 25 | 1.5 | 6.0 | T8 | 0.4 |
| 8 | 25 | 1.5 | 6.0 | T9 | 0.2 |
| 9 | 25 | 1.5 | 6.0 | T10 | 0.8 |
| 10 | 25 | 4.0 | 16.0 | T8 | 0.8 |
| 11 | 25 | 4.0 | 16.0 | T9 | 0.5 |
| 12 | 25 | 4.0 | 16.0 | T10 | 1.7 |

The result of examination is given in Table 6. The polygon formation ratio was less than 3.0% for all the test numbers. However, when the ERW tube having a thickness of 4.0 mm was rolled through the sizer of type T10 whose central angle θ2 was less than 36°, the resulting polygon formation ratio was higher than those of the tubes rolled through the sizers of types T8 and T9. Stated differently, when an ERW tube whose thickness/outer diameter ratio was not less than 16% was rolled, and the central angle θ2 of the bottom of the groove of the roll was not less than 36°, the polygon formation was effectively suppressed. Note that roll edge marks were not caused for any of the test numbers.

The embodiments of the present invention have been shown and described simply by way of illustrating the invention. Therefore, the invention is not limited to the embodiments described above and various modifications may be made therein without departing from the scope of the invention.

The invention claimed is:

1. A reducing mill including a plurality of stands disposed along a rolling direction line, wherein a pipe or tube is rolled through said plurality of stands along said rolling direction line, said stands each include n rolls, wherein n is equal to or greater than 3, disposed around said rolling direction line, said n rolls are disposed shifted by 180°/n around said rolling direction line from n rolls included in a preceding stand, each of said n rolls included in each of said plurality of stands excluding a last stand has a groove having an arch shape in cross section, a bottom of said groove having a circular arc shape having a first radius around said rolling direction line in cross section, a distance between a surface of a roll flange portion positioned between the bottom and an edge of said groove and said rolling direction line is longer than said first radius, and a distance between the edge of said groove and said rolling direction line is longer than the first radius in the groove of a roll included in said preceding stand.

2. The reducing mill according to claim 1, wherein said roll flange portion has an arch shape in cross section.

3. The reducing mill according to claim 2, wherein in cross section of said groove, a tangent on an end of said bottom matches a tangent on an end of said roll flange portion on the side of said bottom.

4. The reducing mill according to claim 3, wherein said roll flange portion has a circular arc shape having a second radius larger than said first radius in cross section.

5. The reducing mill according to claim 1, wherein said roll flange portion has a straight shape in cross section.

6. The reducing mill according to claim 1, wherein n equals 3 and the circular arc of said bottom has a central angle of at least 50°.

7. The reducing mill according to claim 1, wherein n equals 4, and the circular arc of said bottom has a central angle of at least 36°.

* * * * *